US006872153B2

(12) United States Patent
Gilbert et al.

(10) Patent No.: US 6,872,153 B2
(45) Date of Patent: Mar. 29, 2005

(54) GOLF CLUB IRON

(75) Inventors: Peter J. Gilbert, Carlsbad, CA (US); Douglas C. Jorgensen, Carlsbad, CA (US); Stephen S. Murphy, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 10/606,318

(22) Filed: Jun. 25, 2003

(65) Prior Publication Data

US 2004/0266545 A1 Dec. 30, 2004

(51) Int. Cl.[7] ..... A63B 53/04
(52) U.S. Cl. ..... 473/332; 473/333; 473/350
(58) Field of Search ..... 473/350, 332–333

(56) References Cited

U.S. PATENT DOCUMENTS 3,955,820 A * 5/1976 Cochran et al. ..... 473/337
4,535,990 A * 8/1985 Yamada ..... 473/346
4,740,345 A 4/1988 Nagasaki et al. ..... 264/257
4,792,139 A 12/1988 Nagasaki et al. ..... 273/167 H
4,798,383 A 1/1989 Nagasaki et al. ..... 273/167 H
4,848,747 A 7/1989 Fujimura et al. ..... 273/77 A
4,884,812 A 12/1989 Nagasaki et al. ..... 273/167 H
5,026,056 A 6/1991 McNally et al. ..... 273/77 A
5,290,036 A 3/1994 Fenton et al. ..... 273/167 R
5,588,922 A * 12/1996 Schmidt et al. ..... 473/324
5,588,923 A 12/1996 Schmidt ..... 473/340
5,595,234 A 1/1997 Beck ..... 164/9
5,776,010 A 7/1998 Helmstetter et al. ..... 473/334
6,623,374 B1 * 9/2003 Helmstetter et al. ..... 473/291
2001/0055996 A1 * 12/2001 Iwata et al. ..... 473/350
2003/0190975 A1 * 10/2003 Fagot ..... 473/346

* cited by examiner

*Primary Examiner*—Stephen Blau
(74) *Attorney, Agent, or Firm*—D. Michael Burns

(57) ABSTRACT

A golf club iron having a thin front face supported by a biasly bent insert that is inserted into a rear cavity of the iron to both support the front face and to create a "spring like" effect. The coefficient of restitution of the club head is greater than 0.8. The insert has a lower specific gravity and a higher Young's Modulus than the front face.

10 Claims, 2 Drawing Sheets

GOLF CLUB IRON

FIELD OF THE INVENTION

The present invention relates to an improved golf club iron head, and more particularly, the invention relates to a golf club head having an insert wedged behind a thin front face.

BACKGROUND OF THE INVENTION

The desire for perimeter weighting in a golf club iron is well known in the art. This desire stems from the fact that as the mass of the iron is distributed towards the perimeter, the trajectory of the hit ball becomes more consistent for off-center hits away from the sweet spot of the golf club face or hitting surface. Consequently, many modern golf club irons have a "cavity back" design. These clubs are made by removing the weight from the center of the club head and redistributing it along the bottom, the top, the heel and toe portions of the club head. Club heads of the latter type have enjoyed considerable success since they effectively enlarge the "sweet spot" of the club head.

The "sweet spot" of the club head is generally regarded to be that area on the striking face of the club head immediately surrounding the center of gravity of the club head. By enlarging the sweet spot, perimeter weighted club heads allow golfers of all abilities to realize improved results over conventional club heads when the golfer fails to strike the golf ball in line with the center of gravity of the club head. These improved results translate into "mis-hit" shots that travel farther and straighter than they would if struck with a club having another conventional club head design.

The weight saved by creating a rear cavity in the iron, is re-distributed to the perimeter of the golf club head. The greater the volume of the cavity, the greater the amount of mass of metal that can be redistributed to the perimeter of the golf club head. However, if the thickness of the face hitting surface is reduced to an extent where it becomes too thin, the strength of the face becomes too low to resist the force of the ball hitting the face. Thus, it would be desirable to find a way to further increase the volume of the cavity without causing the face to fail upon impact with the ball. One way of achieving this increase in cavity volume is to increase the cross-section of the cavity as it approaches the rear of the front face or hitting surface of the club head, or in other words, create an undercut rear cavity perimeter. Unfortunately, such an undercut perimeter creates a trap area in which dirt and moisture can accumulate, which can otherwise create a surface integrity problem as a result of rust or otherwise detrimentally affect the aesthetics of the club head that can reduce its commercial success.

As is well known in the golf club art, a typical set of men's golf club irons includes 8 or 9 irons having variations in shaft length, weight, lie and loft among other parameters. By way of example, the iron having the lowest weight, longest shaft and the lowest loft is typically the number two iron and the club having the shortest shaft and the highest loft is typically called a wedge.

It would be desirable to provide a means for creating a thin faced club head having a high COR for increased distance in each iron of a set of golf club irons, or at least the longer irons. However, a limiting parameter is when the face thickness becomes so thin, it adversely effects the strength of the face. One well-known cure is to support the face with a low-density insert, preferably one placed into a rear cavity opening. The present invention utilizes the insert to provide an alternative means for increasing the COR.

SUMMARY OF THE INVENTION

The present invention overcomes the disadvantages of the prior art by providing a club head having a low density rear cavity insert, which is bent and introduced into the cavity under tension, thereby creating a spring-like effect upon the front face of the club head during impact.

One embodiment of the invention provides for a club head having a front face and a rear cavity with an L-shaped insert bent into the cavity. The combination of this feature, along with the thinning of the front face, provides a club head having an increased coefficient of restitution (COR).

Another embodiment of the golf club head includes a U-shaped insert inserted into the rear cavity. Preferably, the insert covers at least 50 percent of the height of the front face.

Another embodiment of the invention includes a set of golf irons wherein the long irons include a rear cavity and a rear recess. An insert is bent into place to juxtapose the front face and the top of the sole recess. In some embodiments a void is created between a back surface of the front face and the insert.

In one embodiment, the insert has a Young's Modulus that is greater than that of the front face and a specific gravity less than the club face.

DETAILED DESCRIPTION

Figure 3:
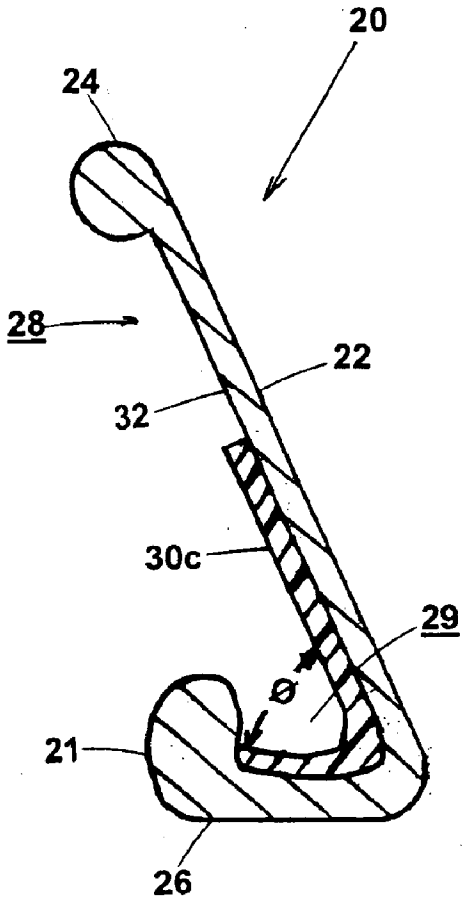
FIG. 3 is a cross-sectional view of a golf club iron head of another embodiment of the invention depicting an L-shaped insert.

Referring to FIGS. 1–5, an iron type golf club head 20 includes a perimeter weight 21 and a front face 22. The perimeter weight 21 includes a top portion 24 and a sole portion 26 that are spaced apart. The club head 20 is preferably cast or forged from suitable material such as stainless steel. The front face 22 is arranged for impact with a golf ball (not shown) and extends between the top and sole portions 24, 26 along a front side of the perimeter weight 21.

Preferably, the golf club iron has a high moment of inertia (MOI). The present invention accomplishes this by positioning the center of gravity low and towards the back of the club head 20. Perimeter weight 21 protrudes rearward from the front face 22 to define a rear cavity 28 and a sole recess 29 in the lower back of the head 20. The sole recess 29 is the area defined by the sole height ht, and the sole width SW of the sole portion 26. The wider sole portion 26 of the invention is also positioned further rearward, thereby creating a lower center of gravity in the club head 20. The repositioned center of gravity helps the flight of the ball obtain a higher trajectory because of the increased dynamic loft that yields a higher launch angle and greater sweet spot when compared to a conventional golf club.

Figure 1:
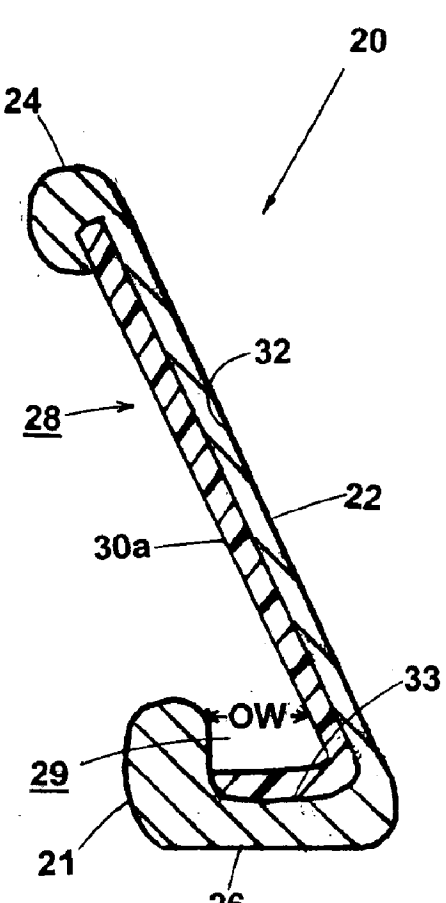
FIG. 1 is a cross-sectional view of a golf club iron head of the present invention showing the relationship of the insert to the front face.

In an embodiment of the invention is shown in FIG. 1, a thin front face 22 is supported by an L-shaped rear cavity insert 30*a*. The insert can be bent when inserted to create potential energy by the insert 30*a* being biasly placed into the rear cavity 28 and sole recess 29. Preferably, the insert 30*a* is bent or flexed at a bend angle Ø that is less than about 95°, and more preferably less than about 80°, and then juxtaposed against a back surface 32 of the front face 22 and an inner surface 33 of the sole portion 26. Prior to being inserted, the insert 30*a* preferably has an angle that is at least 2% larger than angle Ø. This tension creates a leaf spring effect, which helps the club face to achieve a high COR. In a preferred embodiment the COR is greater than 0.79. This is especially desirable in at least the long irons, (2 to 4), and possibly middle irons (5–7). The bent insert 30*a* exerts a pre-load against the front face 22 of between 0 to 3000 lbs, and more preferably about 50 to 1000 lbs.

Figure 2:
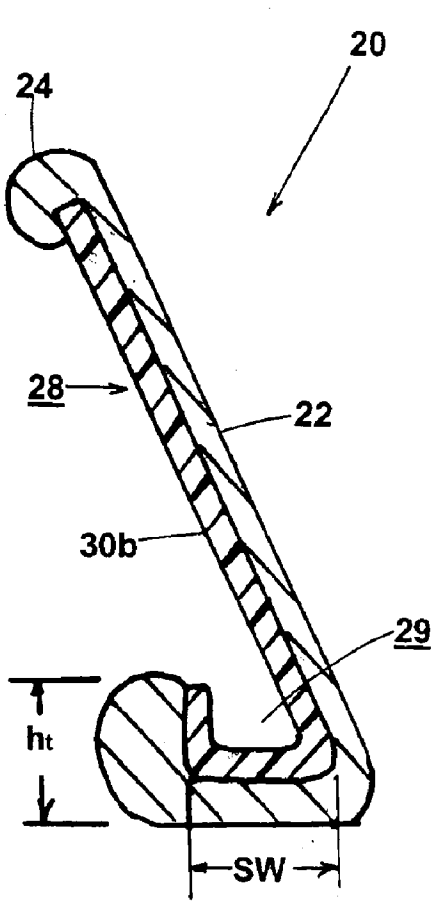
FIG. 2 is a cross-sectional view of a golf club iron head of another embodiment of the invention showing a U-shaped insert.

Embodiments of the invention are illustrated in FIGS. 2–5. In FIG. 2, a U-shaped insert 30*b*, is placed into the rear cavity 28 and sole recess 29 to achieve the spring-like effect. In this U-shaped embodiment, the bend in the insert 30*b* defines an opening width OW, which is less than the sole width SW of the sole recess 29. However, the opening width OW can be larger than the sole width SW of the sole recess 29, prior to the insert 30*b* being located in the rear cavity 28.

Figure 4:
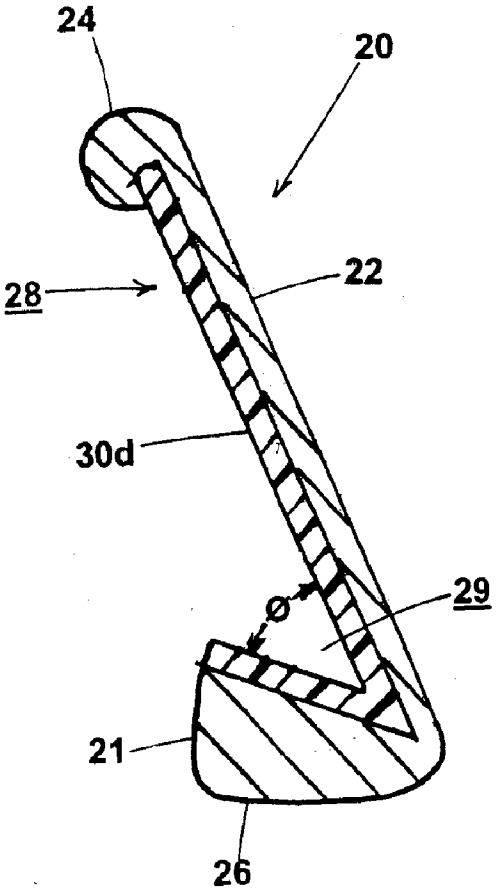
FIG. 4 is a cross-sectional view of a golf club iron head of another embodiment of the invention describing an acutely bent insert.

In FIG. 3, an insert 30*c*, only supports a partial section of the back surface 32. However, the insert 30*c* preferably supports at least 50 percent of the height of the front face 22. In FIG. 4, an embodiment is shown wherein the insert 30*d* is bent at an extremely acute angle and is of a more V-shaped design.

Figure 5:
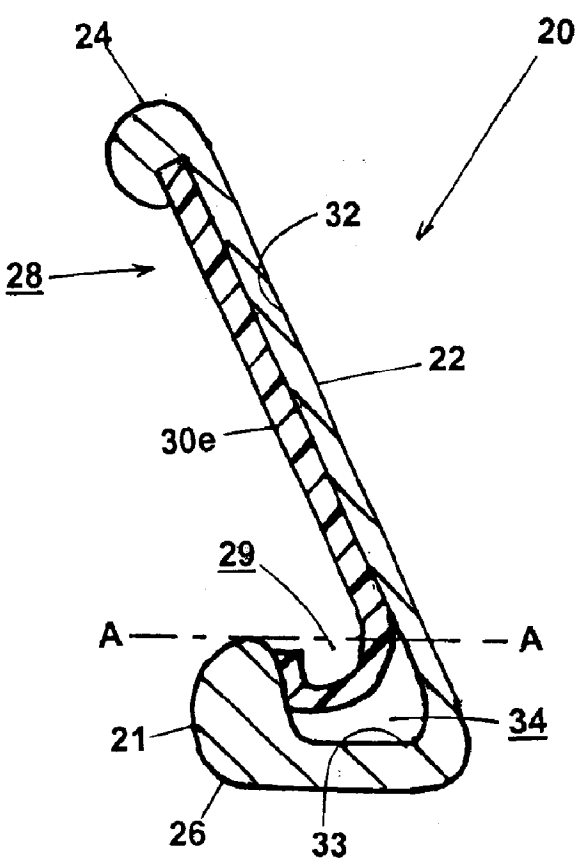
FIG. 5 is a cross-sectional view of a golf club iron head of another embodiment of the invention wherein the insert creates a void in a sole recess.

In the previous embodiments shown in FIGS. 1–4, each of the inserts 30*a, b, c*, and *d*, is at least partially located in both the rear cavity 28 and the sole recess 29, and preferably, the inserts abut the back surface 32 of the front face 22 and the inner surface 33 of the sole portion 26. In FIG. 5 an embodiment is shown wherein the insert 30*e* is bent into place to juxtapose the front face 22 and a top surface A—A of the sole recess 29. A void 34 is thereby created in the sole recess 29 between the insert 30*e* and the back surface 33 of the front face 22 and inner surface 33 of the sole portion 26.

The uniqueness of the present invention may be shown in the manufacturing process of the club head 20, which is forged or cast. The body is generally cast out of a stainless steel. In a forged embodiment, the periphery can be cast or forged and the front face 22 can be made of rolled, stamped or forged high strength steel, such as stainless steel 455 and more preferably stainless steel 465. Using high strength steel permits the front face 22 to be thinned-down. This provides a higher COR face thickness (at least 0.06 to 0.1 inch for long irons).

Composites comprising graphite or Kevlar fibers, as well as low specific gravity metals such as magnesium, titanium and aluminum are desirable materials for the inserts 30*a, b, c, d*, and *e*. The specific gravity of the inserts 30*a–e* are lower than the specific gravity of the front face 22, and preferably are less than 85 percent of the front face's specific gravity. In a preferred embodiment, the specific gravity of the front face 22 is greater than about 7.0 and inserts 30*a–e*, less than about 2.0.

While it is apparent that the illustrative embodiments of the invention herein disclosed fulfills the objectives stated above, it will be appreciated that numerous modifications and other embodiments may be devised by those skilled in the art. Therefore, it will be appreciated that the appended claims are intended to cover all such modifications and embodiments which come within the spirit and scope of the present.

What is claimed is:

1. A golf club head comprising:

a body including a front face, a perimeter weight surrounding the front face to define a rear cavity; and a U-shaped rear cavity insert biasly interposed within the rear cavity so as to create a force against substantially the entire front face, wherein the rear cavity insert is juxtaposed against the entire back surface of the front face inside the cavity to provide support for the entire front face.

2. The golf club head of claim 1, wherein the coefficient of restitution of the golf club head is greater than 0.79.

3. The golf club head of claim 1, wherein the rear cavity insert is a composite laminated sheet of one or more layers.

4. The golf club head of claim 1, wherein prior to insertion the rear cavity insert has an angle that is at least 2% larger than the bend angle.

5. The golf club head of claim 1, wherein the rear cavity insert exerts a pre-load force against substantially the entire front face of between 0–3000 lbs.

6. A golf club head comprising:

a body including a front face and a perimeter weight surrounding the front face and defining a rear cavity;

the perimeter weight including a sole portion having a sole recess defined therein; and a U-shaped rear cavity insert blasly bent within the sole recess so as to create a force against substantially the entire front face, wherein the rear cavity insert is juxtaposed against the entire back surface of the front face inside the cavity and against substantially the entire wall of the sole cavity.

7. The golf club head of claim 6, wherein the coefficient of restitution of the golf club head is greater than 0.79.

8. The golf club head of claim 6, wherein the rear cavity insert is a composite laminated sheet of one or more layers.

9. A set of golf irons comprising:

long irons, each having a body including a front face and a perimeter weight surrounding the front face and defining a rear cavity;

the perimeter weight including a sole portion having a sole recess defined therein;

a U-shaped rear cavity insert biasly bent within sole recess so as to juxtapose against the entire back surface of the front face inside the cavity and a surface of the sole recess, so as to create a force against substantially the entire front face.

10. The set of golf club irons of claim 9, wherein the rear cavity insert is a composite laminated sheet of one or more layers.

* * * * *